US010914177B2

(12) United States Patent
Varney

(10) Patent No.: US 10,914,177 B2
(45) Date of Patent: Feb. 9, 2021

(54) DUAL-WALLED COMPONENTS FOR A GAS TURBINE ENGINE

(71) Applicant: Rolls-Royce Corporation, Indianapolis, IN (US)

(72) Inventor: Bruce Edward Varney, Greenwood, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 16/730,773

(22) Filed: Dec. 30, 2019

(65) Prior Publication Data

US 2020/0149408 A1 May 14, 2020

Related U.S. Application Data

(63) Continuation of application No. 15/264,338, filed on Sep. 13, 2016, now Pat. No. 10,519,780.

(51) Int. Cl.
*F01D 5/18* (2006.01)
*F01D 9/06* (2006.01)

(52) U.S. Cl.
CPC ..... *F01D 5/186* (2013.01); *F01D 5/189* (2013.01); *F01D 9/065* (2013.01); *F05D 2230/11* (2013.01); *F05D 2260/204* (2013.01)

(58) Field of Classification Search
CPC ..... F01D 5/186; F01D 5/189; F01D 9/065; F05D 2230/11; F05D 2260/204
See application file for complete search history.

(56) References Cited

U.S. PATENT DOCUMENTS

| | | | | |
|---|---|---|---|---|
| 3,584,972 | A | 6/1971 | Bratkovich et al. | |
| 3,698,834 | A | 10/1972 | Meginnis | |
| 3,806,276 | A * | 4/1974 | Aspinwall | F01D 5/189 416/97 R |
| 4,233,123 | A | 11/1980 | Hammer, Jr. | |
| 4,312,186 | A | 1/1982 | Reider | |
| 5,130,163 | A | 7/1992 | Clingman et al. | |
| 5,152,667 | A | 10/1992 | Turner et al. | |
| 5,176,499 | A | 1/1993 | Damlis et al. | |
| 5,640,767 | A | 6/1997 | Jackson et al. | |
| 6,039,537 | A * | 3/2000 | Scheurlen | F01D 5/186 415/115 |
| 6,213,714 | B1 | 4/2001 | Rhodes | |
| 6,321,449 | B2 | 11/2001 | Zhao et al. | |

(Continued)

OTHER PUBLICATIONS

Prosecution History from U.S. Appl. No. 15/264,338, dated Jan. 22, 2019 through Aug. 30, 2019, 37 pp.

(Continued)

*Primary Examiner* — Jesse S Bogue
(74) *Attorney, Agent, or Firm* — Shumaker & Sieffert, P.A.

(57) ABSTRACT

Techniques for forming a dual-walled component for a gas turbine engine that include chemically etching at least one of a hot section part or a cold section part to form an etched part having plurality of support structures and bonding the etched part to a corresponding cold section part or a corresponding hot section part to form a dual-walled component, with the plurality of support structures defining at least one cooling channel between the at least one of the hot section part or the cold section part and the corresponding cold section part or the corresponding hot section part.

20 Claims, 5 Drawing Sheets

(56) References Cited

U.S. PATENT DOCUMENTS

| | | | | |
|---|---|---|---|---|
| 6,602,053 | B2 * | 8/2003 | Subramanian | C25D 1/02 416/241 B |
| 6,709,230 | B2 * | 3/2004 | Morrison | F01D 5/288 415/115 |
| 6,932,571 | B2 | 8/2005 | Cunha et al. | |
| 8,109,735 | B2 | 2/2012 | Gage et al. | |
| 9,003,657 | B2 | 4/2015 | Bunker et al. | |
| 10,012,107 | B2 | 7/2018 | Maier et al. | |
| 10,450,871 | B2 * | 10/2019 | Henderkott | F23R 3/002 |
| 2012/0156054 | A1 | 6/2012 | Lacy et al. | |
| 2012/0295061 | A1 | 11/2012 | Bunker et al. | |
| 2013/0025288 | A1 | 1/2013 | Cunha et al. | |
| 2014/0212628 | A1 * | 7/2014 | Lin | B23K 9/04 428/172 |
| 2014/0255206 | A1 | 9/2014 | Knorr et al. | |
| 2014/0257551 | A1 | 9/2014 | Junod et al. | |
| 2014/0260282 | A1 | 9/2014 | Pinnick et al. | |
| 2015/0013340 | A1 | 1/2015 | Pinnick et al. | |
| 2016/0160655 | A1 | 6/2016 | O'Connor et al. | |
| 2018/0073396 | A1 | 3/2018 | Varney | |

OTHER PUBLICATIONS

Prosecution History from U.S. Appl. No. 15/264,098, dated Feb. 6, 2019 through Dec. 6, 2019, 79 pp.

* cited by examiner

DUAL-WALLED COMPONENTS FOR A GAS TURBINE ENGINE

This application is a continuation of U.S. application Ser. No. 15/264,338, filed Sep. 13, 2016, which is incorporated herein by reference in its entirety.

TECHNICAL FIELD

The present disclosure relates to coversheets and spars for forming a dual-walled component of a gas turbine engine.

BACKGROUND

Hot section components of a gas turbine engine may be operated in high temperature environments that may approach or exceed the softening or melting points of the materials of the components. Such components may include air foils including, for example turbine blades or foils which may have one or more surfaces exposed to high temperature combustion or exhaust gases flowing across the surface of the competent. Different techniques have been developed to assist with cooling of such components including for example, application of a thermal barrier coating to the component, construction the component as single or dual-walled structure, and passing a cooling fluid, such as air, across or through a portion of the component to aid in cooling of the component.

SUMMARY

In some examples, the disclosure describes a techniques for forming a dual-walled component for a gas turbine engine that include chemically etching at least one of a hot section part or a cold section part to form an etched part having plurality of support structures and bonding the etched part to a corresponding cold section part or a corresponding hot section part to form a dual-walled component, with the plurality of support structures defining at least one cooling channel between the at least one of the hot section part or the cold section part and the corresponding cold section part or the corresponding hot section part.

In some examples, the disclosure describes a technique for forming a dual-walled component for a gas turbine engine, the dual-walled component including a spar including a superalloy material and a coversheet bonded to the spar. In some examples, the technique includes chemically etching a surface of at least one of the spar or the coversheet to form a plurality of support structures and bonding the coversheet to the spar, with the plurality of support structures defining at least one cooling channel between the spar and the coversheet.

In some examples, the disclosure describes a dual-walled component that includes a cold section part having a bond surface that defines a plurality of impingement apertures; a hot section part that includes a plurality of support structures extending from a first surface and defining at least one cooling channel, the hot section part defining a plurality of cooling apertures that extend through the hot section part; and a plurality of braze or diffusion bond joints that fix the cold section part to the hot section part, where the plurality of braze or diffusion bond joints are formed at interfaces between the plurality of support structures and the bond surface of the cold section part.

The details of one or more examples are set forth in the accompanying drawings and the description below. Other features, objects, and advantages will be apparent from the description and drawings, and from the claims.

DETAILED DESCRIPTION

In general, the disclosure describes techniques for forming dual-walled components using at least one chemical etching process. Hot section components, such as a flame tube or combustor liner of a combustor and air foils of a gas turbine engine may be operated in high temperature gaseous environments. In some such examples, the temperature of the gaseous environments may approach or exceed the operational parameters for the respective component. Indeed, in some instances, operating temperatures in a high pressure turbine section of a gas turbine engine may exceed melting or softening points of the superalloy materials used in turbine components. In some examples, to reduce or substantially the risk of melting of the engine components, the component may include a dual-walled structure that includes cooling channels and cooling apertures within the dual-walled structure. In some examples, the cooling system may function by flowing relatively cold air from the compressor section of the gas turbine engine through the cooling channels of the dual-walled structure. These channels may exhaust some or all of the cooling air through cooling apertures in the surfaces of the outer wall of the dual-walled component. In some examples, the exhausted cooling air may protect the dual-walled component in such high temperature gaseous environments by, for example, reducing the relative temperature of the component, creating a film of cooling air passing over the surface of the component exposed to the high temperature environment, reducing the temperature of the gas within the high temperature environment, or a combination of two or more of these effects.

In some examples, the dual-walled component may be formed by bonding multiple parts of a component (e.g., a coversheet and spar of an airfoil) together. In some examples, prior to bonding the components, one or more surfaces of the components may be etched to define one or more of the cooling channels, cooling apertures, or impingement apertures of the resultant dual-walled component. The disclosed examples and techniques described herein may be used to improve the manufacturing efficiencies for such components as well as the overall cooling efficiencies of the gas turbine engines in which the components are installed.

Figure 1:
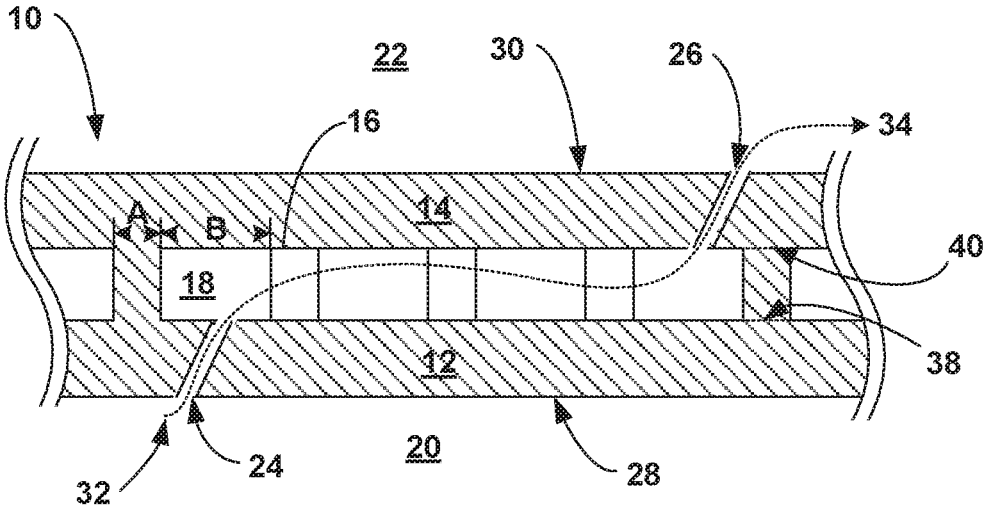
FIG. 1 is conceptual cross-sectional view of an example dual-walled component of a gas turbine engine that includes a cold section part and a hot section part that define a plurality of support structures connecting the cold section part to the hot section part.

FIG. 1 is conceptual cross-sectional view of an example dual-walled component 10 of a gas turbine engine that includes a cold section part 12 and a hot section part 14 connected by a plurality of support structures 16. Dual-walled component 10 may be configured to separate a cooling air plenum 20 from a heated gas environment 22 such that dual-walled component 10 acts as a physical divider between the two mediums. The terms "hot section part" and "cold section part" are used merely to orient which part is positioned adjacent to cooling air plenum 20 and which part is positioned adjacent to heated gas environment 22 and is not intended to limit the relative temperatures of the different environments or parts. For example, while cold section part 12 and cooling air plenum 20 may be described herein as "cold" sections compared to hot section part 14 and heated gas environment 22, the respective temperatures of cold section part 12 or cooling air plenum 20 may reach relatively high temperatures between about 1400° F. to about 2400° F. (e.g., about 760° C. to about 1300° C.) during routine operation.

In some examples, dual-walled component 10 may be a component of the hot-section of a gas turbine engine (e.g., combustor, turbine, or exhaust sections) that receives or transfers cooling air as part of cooling system for a gas turbine engine. Dual-walled component 10 may include, for example, a components of combustor such as a flame tube, combustion ring, combustor liner, an inner or outer casing, a guide vane, or the like; a component of a turbine section such as a nozzle guide vane, a turbine disc, a turbine blade, or the like; or another component associated with the hot section (e.g., a combustor or a high, low, or intermediate pressure turbine, or low pressure turbine) of a gas turbine engine.

In some examples, cold section part 12 and hot section part 14 may be separated and attached by a plurality of support structures 16. In addition to attaching cold section part 12 to section part 14, the plurality of support structures 16 may define one or more cooling channels 18 between cold section part 12 and hot section part 14 amongst support structures 16. In some examples, cold section part 12 includes a plurality of impingement apertures 24 along surface 28 of cold section part 12 extending between cooling air plenum 20 and the one or more cooling channels 18. Similarly, in some examples, hot section part 14 may include a plurality of cooling apertures 26 in surface 30 of hot section part 14 that extend between one or more cooling channels 18 and heated gas environment 22. During operation of dual-walled component 10, cooling air 32 from cooling air plenum 20 may pass through impingement apertures 24 entering and flowing through one or more cooling channels 18 prior to passing through cooling apertures 26 into heated gas environment 22.

In some examples, cooling air 32 may assist in maintaining the temperature of dual-walled component 10 at a level lower than that of heated gas environment 22. For example, the temperature of the air within cooling air plenum 20 may be less than that of hot gas environment 22. Cooling air 32 may flow through impingement apertures 24 and impinge on the internal surface of hot section part 14, resulting in heat transfer from hot section part 14 to cooling air 32. Additional heat may be transferred from hot section part 14 and plurality of support structures 16 as cooling air 32 flows through one or more cooling channels 18. Further, cooling air 32 may exit cooling apertures 26 and enter heated gas environment 22, creating a thermally insulating film of relatively cool gas along surface 30 of dual-walled component 10 that allows surface 30 of dual-walled component 10 to remain at a temperature less than that of the bulk temperature of heated gas environment 22. In some examples, cooling air 32 may also at least partially mix with the gas of heated gas environment 22, thereby reducing the relative temperature of heated gas environment 22.

In some examples, the presence of cooling channels 18 may create a zoned temperature gradient between the respective regions of cooling air plenum 20, cooling channels 18, and heated gas environment 22. In some examples, dual-walled component 20 and the presence of cooling channels 18 may allow for more efficient cooling of the component compared to a comparable single-walled component.

In some examples, cooling air 32 may act as a cooling reservoir that absorbs heat from portions of dual-walled component 10 as the air passes through one or more of cooling channels 18, impingement apertures 24, cooling apertures 26, or along one or more of the surfaces of dual-walled component 10, thereby dissipating the heat of dual-walled component 10 and allowing the relative temperature of dual-walled component 10 to be maintained at a temperature less than that of heated gas environment 22. In some examples, maintaining the temperature of dual-walled component 10 within a range less than that of heated gas environment 22 may increase the engine efficiency.

Cooling air plenum 20 and heated gas environment 22 may represent different flow paths, chambers, or regions within the gas turbine engine in which dual-walled component 10 is installed. For example, in some examples where dual-walled component 10 is a flame tube of a combustor of a gas turbine engine, heated gas environment 22 may include the combustion chamber within the flame tube and cooling air plenum may include the by-pass/cooling air that surrounds the exterior of the flame tube. In some examples in which dual-walled component 10 is a turbine blade or vane, heated gas environment 22 may include the environment external to and flowing past the turbine blade or vane while cooling air plenum 20 may include one or more interior chambers within the turbine blade or vane representing part of the integral cooling system of the gas turbine engine. In such examples, cold section part 12 may represent the spar of an airfoil and hot section part 14 may represent one or more of the coversheets bonded to the spar.

In some examples, cooling air 32 may be supplied to dual-walled component 10 (e.g., via cooling air plenum 20) at a pressure greater than the gas path pressure within heated gas environment 22. The pressure differential between cooling air plenum 12 and heated gas environment 22 may force cooling air 32 through one or more of the flow paths established by cooling channels 18, impingement apertures 24, and cooling apertures 26 (collectively flow paths 34).

In some examples, dual-walled component 10 may be constructed with a ceramic matrix composite, a superalloy, or other materials used, e.g., in the aerospace industry. However, dual-walled component 10 may be formed of any suitable materials, including materials other than those mentioned above. In some examples, the respective hot section part 14 and cold section part 12 of dual-walled component 10 may be formed using a suitable technique including, for example, casting the separate parts. In some examples, hot section part 14 and cold section part 12 may each be formed to define a thickness from about 0.014 inches to about 0.300 inches (e.g., about 0.36 mm to about 7.62 mm).

In some examples, dual-walled component 10 may be formed using an adaptive machining process where cold section part 12 and hot section part 14 are formed by, for example, a casting process in which the respective parts are independently formed. In such examples, support structures 16 may be integrally formed as part of the casting process of cold section part 12. Once casted, a separate machining process may be implemented to tailor a specific cold section part 12, including support structures 16, to a pair with a specific hot section part 14 (or vice versa) followed by brazing or diffusion bonding the two parts together. Due to the structural complexity of the bonding surfaces between cold section part 12 and hot section part 14 (e.g., the bonding surface established between support structures 16 and hot section part 14) the respective parts may require extensive, complex machining to establish an appropriate bond surface between a specific cold section part 12 and a specific hot section part 14. For example, a digital model of a cold section part (e.g., spar) including support structures may be constructed to determine the dimensional variations of the bond surfaces of the support structures compared to a theoretical standard. The bond surface of a hot section component (e.g., coversheet) can similarly be mapped and compared to determine which support structures, and to what extent are outside of tolerance limits. An adaptive machining process may then be determined an implemented to machine specific bond surfaces of the support sutures to ensure all bond surfaces are brought within tolerance limits. Such component-specific machining may be costly, time consuming, and inefficient for producing dual-walled components or airfoils on a large scale.

In some examples, the manufacturing techniques disclosed herein may be used to reduce or altogether eliminate the amount of adaptive machining needed to pair a specific cold section part 12 to a hot section part 14. For example, unlike traditional manufacturing techniques, using the techniques described herein, cold section part 12 and hot section part 14 may each be formed (e.g., via casting) absent the presence of any support structures 16. The plurality of support structures 16 may then be formed on one or more of cold section part 12 or hot section part 14 after the respective parts have been cast and machined to corresponding and compatible surfaces. In some such techniques, the respective corresponding and compatible surfaces of cold section part 12 and hot section part 14 may be machined to a nominal size (e.g., machined to a set standard of specifications) allowing the respective parts to be used interchangeably with corresponding parts rather than the being machined to part specific specifications (e.g., serial number pairing of a hot section part to a cold section part).

In some examples, machining of the respective pairing surfaces between cold section part 12 and hot section part 14 with support structures 16 excluded from either of the respective surfaces may improve the production efficiency as the relative size and/or delicateness of the respective support structures 16 may otherwise prohibit certain types of manufacturing techniques.

As described below, after cold section part 12 and hot section part 14 have been machined to exhibit corresponding and complementary surfaces, one or more of the complementary surfaces of cold section part 12 or hot section part 14 may be chemically etched to form a selected pattern of support structures 16. In some examples, the described etching techniques may form support structures 16 more effectively (e.g., less prone to defects or flaws) comparted to traditional integral casting techniques. For example, the etching techniques may remove material from the respective part (e.g., cold section part 12) in a highly controlled and efficient manner compared to integral casting techniques which may introduce flaws into the support structure pattern during the casting process or while the part is removed from the casting mold. Additionally or alternatively, with an integral casting technique, the resultant support structures 16 may be subsequently damaged as a result of mechanical strain imposed on the respective support structures 16 during subsequent machining processes. In contrast, by forming support structures 16 using the described etching techniques, support structures 16 may be formed after all machining between the bond surfaces of cold section part 12 and hot section part 14 is substantially complete, thereby reducing or altogether eliminating the mechanical strain imposed on the respective support structures 16 as a result of machining processes.

Additionally or alternatively, chemical etching process described herein may allow the size of support structures 16 and/or cooling channels 18 to remain relatively small compared to traditional form casting techniques. In some examples, by decreasing size of support structures 16 and/or cooling channels 18, the heat transfer between the resultant dual-walled component and cooling air passed through cooling channels 18 may be increased by providing additional surface area for the convective cooling between the support structures 16 and cooling channels 18. The net effect may improve the overall cooling efficiency of the resultant dual-walled component 10. In some examples, the relative size of support structures 16 and cooling channels 18 (e.g., dimensions A and B in FIG. 5) may be between about 0.2 millimeters (mm) and about 2 mm.

Plurality of support structures 16 may take on any useful configuration, size, shape, or pattern. In some examples, the height of plurality of support structures 16 may be between about 0.2 mm and about 2 mm to define the height of cooling channel 18. In some examples, plurality of support structures 16 may include a plurality of columns, spires, pedestals, or the like separating cold section part 12 from hot section part 14 and creating a network of cooling channels 18 there between. In some examples, plurality of support structures 16 may also include one or more dams that act as zone dividers between adjacent cooling channels 18, thereby separating one cooling channel 18 from another between cold section part 12 from hot section part 14. The introduction of dams within dual-walled component 10 may assist with maintaining a more uniform temperature across surface 30 of hot section part 14. In some examples, the pattern of cooling channels 18 may resemble a grid, wave, serpentine, swirl, or the like. Example patterns and arrangements of cooling channels are disclosed and described in U.S. Pat. No. 6,213,714 issued Apr. 10, 2001 entitled COOLED AIRFOIL, which is incorporate by reference in its entirety.

In some examples, the etching techniques described herein may be used to integrally form support structures 16 as part of hot section part 14 which may have otherwise been prohibited as part of traditional integral casting techniques due to the geometry of hot section part 14. For instance, in examples in which dual-walled component 10 is an airfoil of a gas turbine engine, cold section part 12 may be a spar and hot section part 14 may be a coversheet for the spar. Hot section part 14 may be curved with a bond surface being defined by the concave portion of the curved coversheet. For example, hot section part 14 may correspond to a coversheet for the leading edge of a turbine airfoil with the concave surface of the coversheet being bonded to the convex portion of the spar. In some examples, as a result of the concave curvature of the hot section part 14 it may be impossible or physically impractical to form support structures 16 on the concaved surface of hot section part 14 due to one or more or the constraints associated with the integral casting techniques or the constraints associate with adaptive machining of support structures 16 on the concave surface of hot section part 14. Such constraints may be avoided using the etching techniques described herein, thereby permitting support structures 16 to be formed on a concave surface of hot section part 14.

Figure 2A:
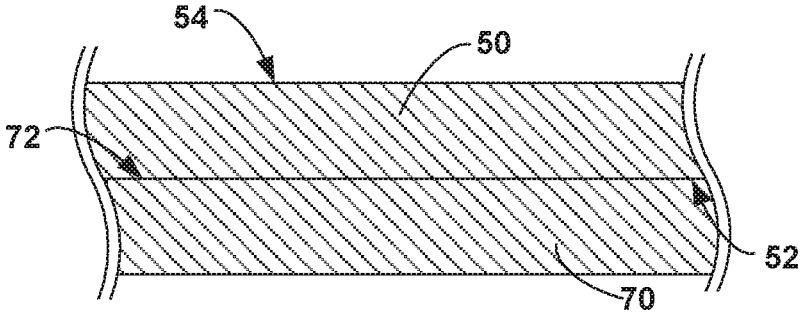
FIGS. 2A-2E illustrate a series of cross-sectional views showing an example dual-walled component that may be formed using the chemical etching techniques described herein.
Figure 2B:
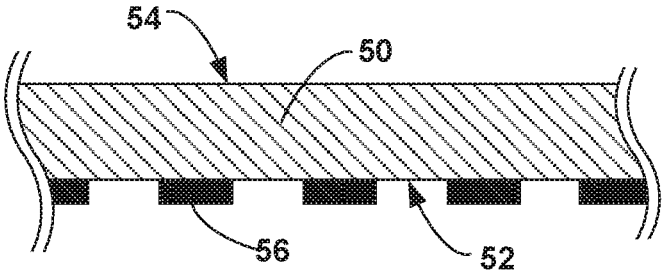
Figure 2C:
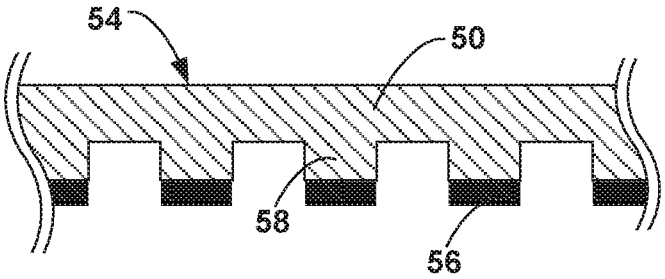
Figure 2D:
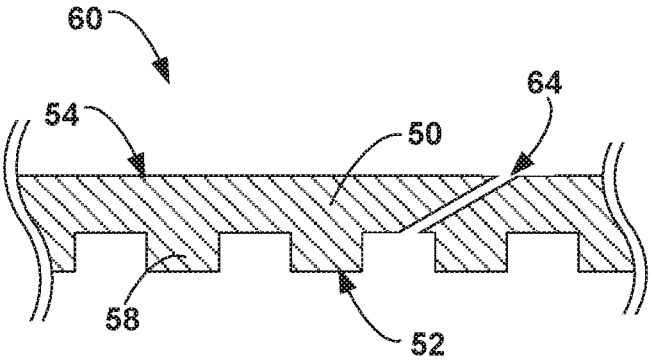
Figure 2E:
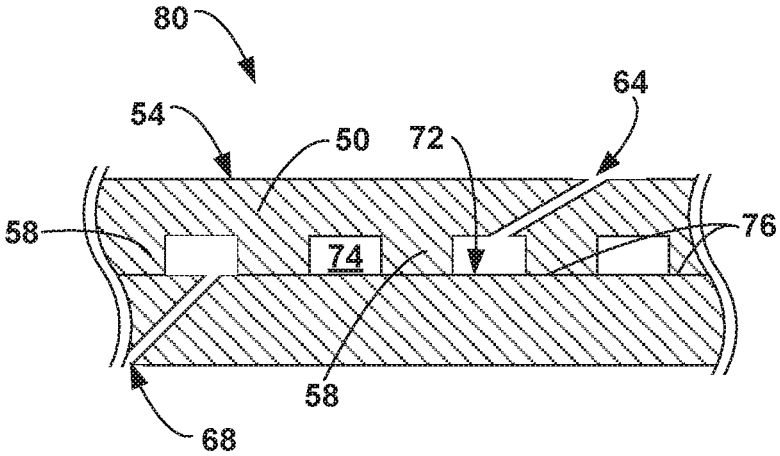

FIGS. 2A-2E illustrate a series of cross-sectional views showing an example of how a dual-walled component 80 may be formed using the chemical etching techniques described herein. FIG. 2A illustrates hot section part 50 and cold section part 70 initially formed to have corresponding and complementary bonding surfaces 52, 72. In some examples, hot section part 50 and cold section part 70 may be initially cast using casting techniques with each respective part initially devoid of support structures 58 and machined to nominal size. FIG. 2B illustrates a masking material 56 on bond surface 52 that defines a cooling channel 74 pattern being applied to the bond surface 52 of hot section part 50. FIG. 2C illustrates hot section part 50 after removal of material from hot section part 50 through a chemical etching process as described herein to form an etched part 60 that defines plurality of support structures 58 and cooling channels 74. FIG. 2D illustrates etched part 60 with cooling apertures 64 being formed in exterior surface 54. Cooling apertures 64 fluidly connect exterior surface 54 with cooling channels 74. FIG. 2E illustrates hot section part 50 and cold section part 70, post bonding. As shown, the resultant bond joints 76 are formed along the interface between cold section part 70 and support structures 58. The bond joints 76 may be formed using diffusion bonding, brazing, or the like.

In some examples, forming support structures 58 within hot section part 50 may provide more efficient air-cooling of dual-walled component 80 compared to a comparable component with support structures 58 formed within cold section part 70. For example, during operation cooling air passing through cooling channels 74 absorbs heat from hot section part 50. The efficiency of heat transferred from hot section part 50 to the cooling air within cooling channels 74 may depend on a variety of factors including, but not limited to, the thermal conductivity of hot section part 50, the total area of direct contact between hot section part 50 and the cooling air within cooling channels 74, the total area of direct contact between support structures 58 and the cooling air within cooling channels 74. While forming support structures 58 within hot section part 50 or cold section part 70 may not substantially change total area of direct contact between the cooling air within cooling channels, forming support structures within hot section part 50 will effectively position the bond joint 76 formed between hot section part 50 and cold section part 70 at the interface between cold section part 70 and support structures 58 (e.g., position 38 of FIG. 1). In contrast, forming support structures 58 within cold section part 70 will effectively position the bond joint at the interface between hot section part 50 and support structures 58 (e.g., position 40 of FIG. 1).

In some examples, the resultant bond joint 76 between hot section part 50 and cold section part 70 may exhibit a thermal conductivity that is different (e.g., less) than thermal conductivity of hot section part 50. In some such examples, the resultant bond joint may act as a thermal resistor that inhibits the transfer of heat from hot section part 50 across the respective bond joint 76. In examples where the bond joint is positioned at the interface between support structures 58 and hot section part 50 (e.g., position 40 of FIG. 1), the bond joint may impede the transfer of heat from hot section part 50 to support structures 58. The net effect of such a configuration may result in less heat being transferred to the cooling air flowing within cooling channels 74. In contrast, when the relative position of bond joint 76 is shifted to the interface between cold section part 70 and support structures 58, heat may efficiently flow from hot section part 50 to support structures 58. The net effect of such a configuration may result in more heat being transferred to the cooling air flowing within cooling channels 74.

In some examples, by forming support structures 58 within hot section part 50 the resultant air cooling system in which dual-walled component 80 is installed may operate more efficiently by transferring more heat to the cooling air within cooling channels 74 per unit of volume flowing through dual-walled component 80. As a result, less cooling air may be required to sufficiently cool dual-walled component 80 compared to similar components where the bond joint is formed along the interface between support structures 58 and hot section part 50 (e.g., position 40 of FIG. 1). Additionally or alternatively, the relative temperature of the heated gas environment adjacent to surface 54 may remain comparatively higher while dual-walled component 80 is maintained at a sufficiently low temperature, thereby allowing the turbine engine to operate at a higher level of efficiency and utilize less fuel.

Plurality of cooling apertures 64 and impingement apertures 68 (collectively apertures 64, 68) may be positioned in any suitable configuration and location about the respective surfaces of hot section part 50 and cold section part 70 of dual-walled component 10. For example, cooling apertures 64 may be positioned along the leading edge of a gas turbine airfoil (e.g., blade or vane). In some examples, apertures 64, 68 may be oriented at an incidence angle less than 90 degrees, i.e., non-perpendicular, to an exterior surface 54 of dual-walled component 80. In some examples the angle of incidence may be between about 10 degrees and about 75 degrees to exterior surface 54 of dual-walled component 80. In some such examples, adjusting the angle of incidence of apertures 64, 68 may assist with the flow of the cooling air or creating a cooling film of cooling air along surface 54 of dual-walled component 80. Additionally or alternatively, one or more of cooling apertures 64 may include a fanned Coanda ramp path at the point of exit from surface 54 to assist in the distribution or film forming characteristics of the cooling air along surface 54 as the cooling air exits the respective cooling aperture 64. In some examples, film cooling holes are shaped to reduce the use of cooling air.

Figure 3:
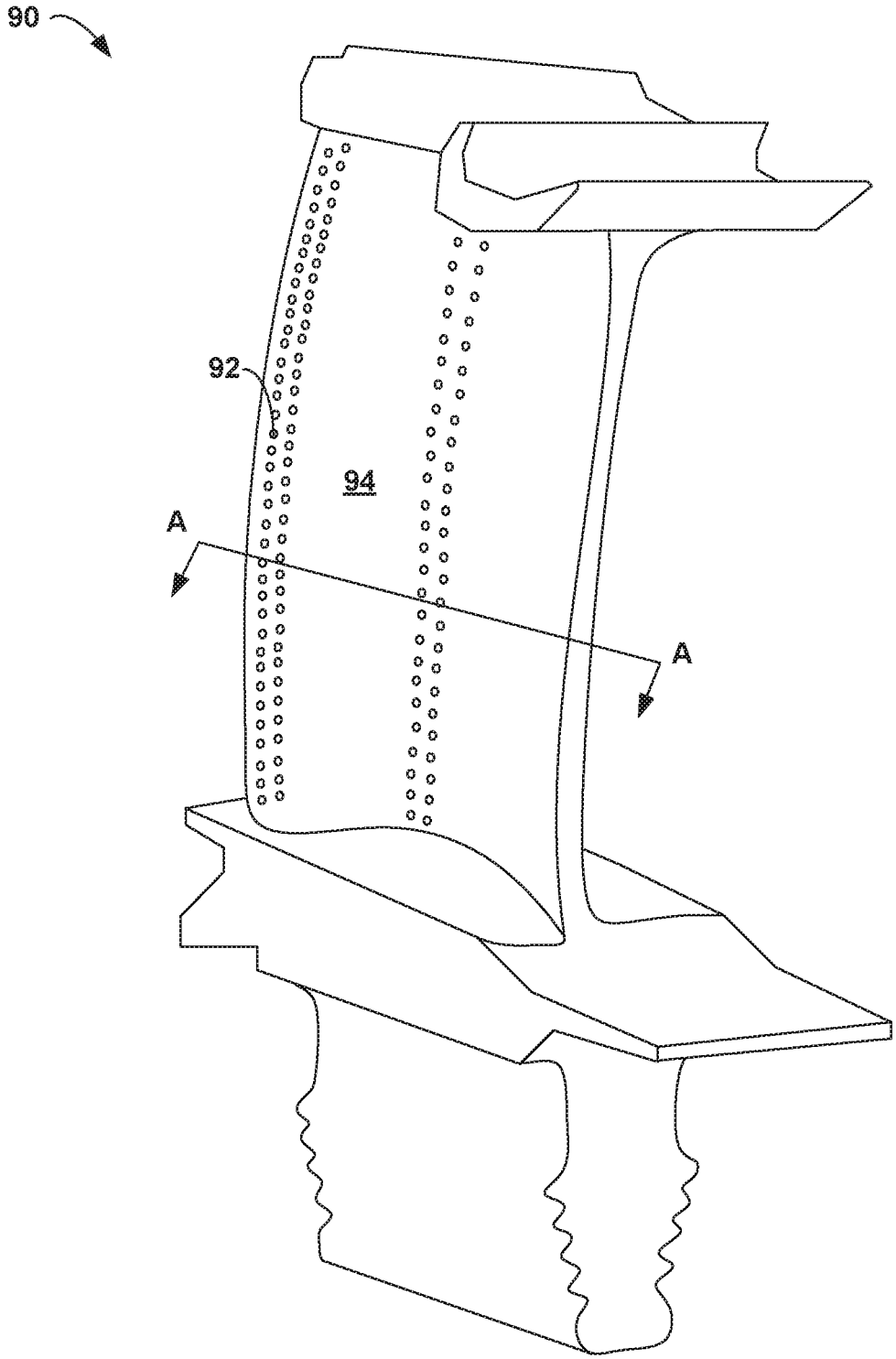
FIGS. 3 and 4 are conceptual diagrams of example turbine airfoil for use in a gas turbine engine includes an etched dual-walled structure.
Figure 4:
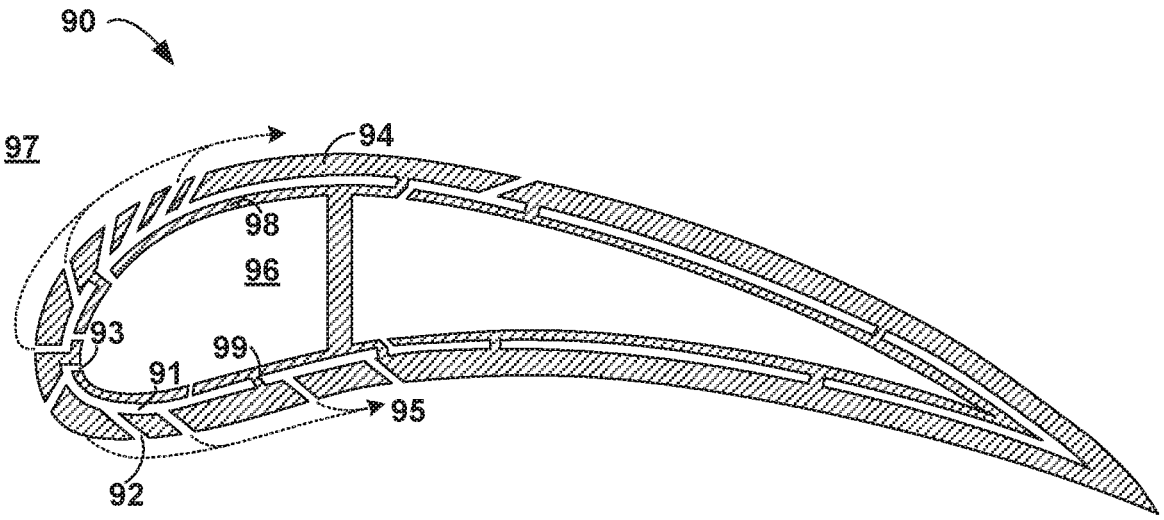

FIG. 3 illustrates an example turbine airfoil 90 that includes a plurality of cooling apertures 92 arranged on a coversheet 94 (e.g., hot section part) of the airfoil. Turbine airfoil 90 may be dual-walled component as described above with respect to FIGS. 1 and 2. FIG. 4 illustrates a cross-sectional view of turbine airfoil 90 along line A-A. As shown in FIG. 4, turbine airfoil 90 includes spar 98 (e.g., cold section part) and at least one coversheet 94 (e.g., hot section part) bonded to spar 98. Spar 98 may define at least one cooling air plenum 96 that fluidly connects to heated gas environment 97, which is the environment exterior to coversheet 94. Coversheet 94 includes a plurality of cooling apertures 92 and spar 98 likewise includes a plurality of impingement apertures 93. At least one of coversheet 94 or spar 98 are etched to define plurality of support structures 99 and cooling channels 91 configured to allow cooling air 95 to flow from inner cooling air plenum 96 through impingement apertures 93, into cooling channels 91, before exiting through cooling apertures 92 into heated gas environment 97.

In some examples, coversheet 94 may be shaped to substantially correspond to or be complementary to an outer surface of spar 98. In some examples, the bonding surface of coversheet 94 may be at least partially concave and corresponding bonding surface of spar 98 may be at least partially convex. In some such examples, the etching techniques described herein may be applied to the concave surface of coversheet 94 to define support structures 99 within the concave surface of coversheet 94, which may have otherwise not been possible due to physical constraints or limitation with casting or adaptively machining the support structures into a concave surface of a coversheet.

Figure 5:
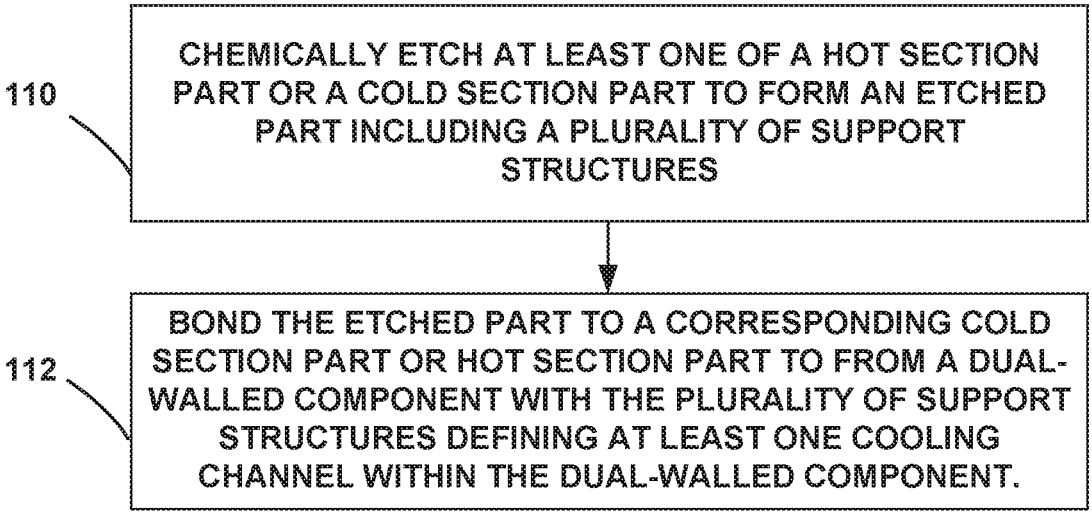
FIGS. 5 and 6 are flow diagrams illustrating example chemical etching techniques for forming dual-walled component of a gas turbine engine.
Figure 6:
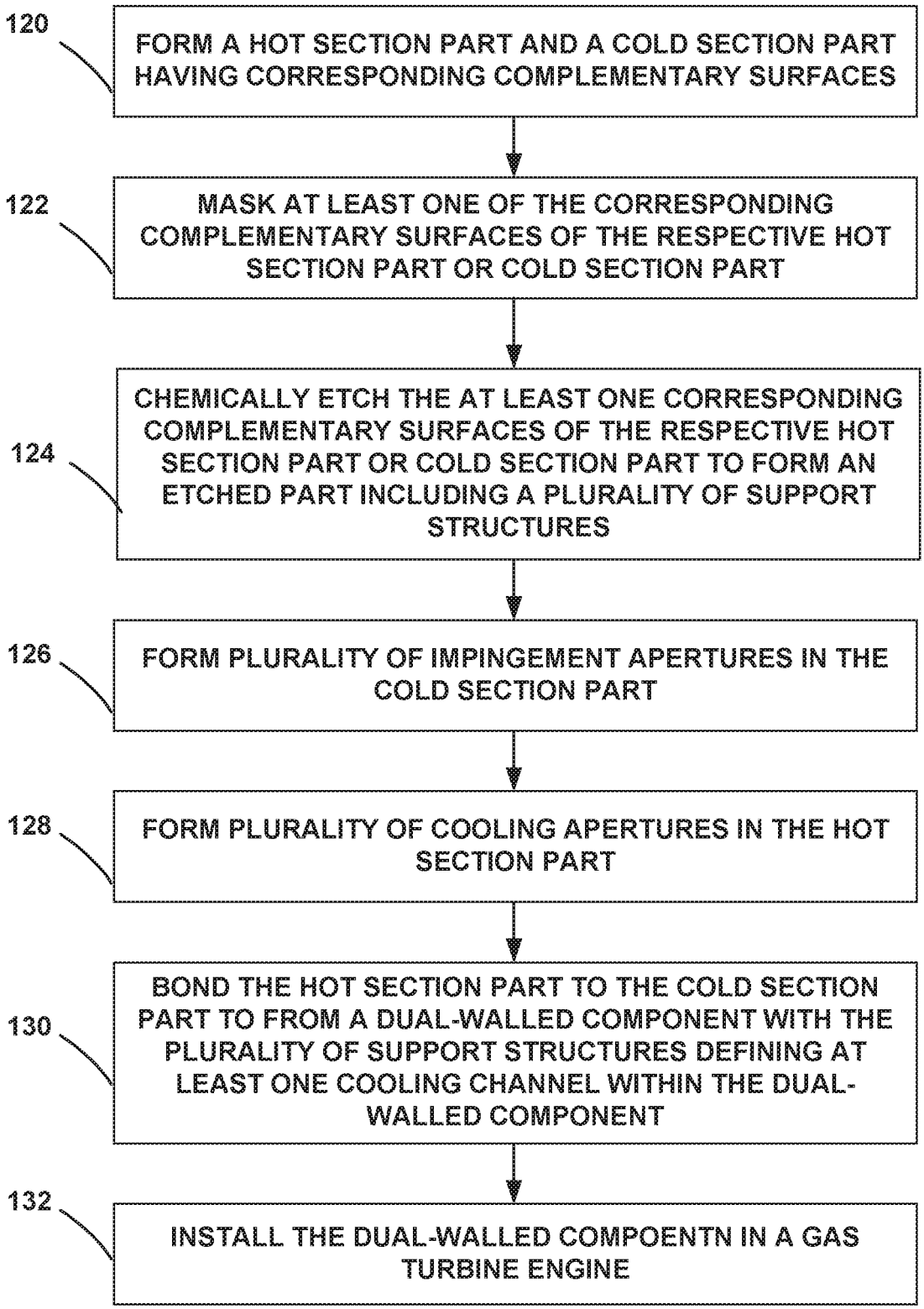

The components described herein may be formed using suitable etching techniques. FIGS. 5 and 6 are flow diagrams illustrating an example techniques of manufacturing described dual-walled components. For ease of illustration, the example methods of FIGS. 5 and 6 are described with respect to the dual-walled component and parts of FIGS. 2A-2E; however, other dual-walled components of a gas turbine engine may be formed using the described techniques including, for example, flame tubes, combustor rings, combustion chambers, casings of combustion chambers, turbine blades, turbine vanes, or the like; all of which are envisioned within the scope of the techniques of FIGS. 5 and 6.

The example technique of FIG. 5 includes chemically etching at least one of a hot section part 50 or a cold section part 70 to form an etched part 60 having a plurality of support structures 58 (110) and bonding etched part 50 to a corresponding cold section part 70 or hot section part 50 to form a dual-walled component 80 with plurality of support structures 58 forming at least one cooling channel 74 within dual-walled component 80 (112). While the below descriptions describe the etching as being applied to hot section part 50, in some examples the chemical etching process may be conversely applied to cold section part 70, or applied to a combination of both cold section part 70 and hot section part 50. All scenarios are intended to be covered within the scope of this disclosure and the below description is not intended to limit the chemical etching process to only being applied to hot section part 50.

As described above, dual-walled component 80 may be a component for a gas turbine engine that works integrally with the air-cooling system of a gas turbine engine. In some examples, dual-walled component 80 may include an airfoil for a gas turbine engine such that the cold section part 70 corresponds to the spar of an air foil and hot section part 50 corresponds to a coversheet for the spar.

In some examples, if necessary, the bonding surfaces of the hot section part 50 and cold section part 70 (e.g., surface 52 of hot section part 50 and surface 72 of cold section part 70) may be initially machined prior to etching so the bonding surfaces form corresponding and complementary surfaces with one another to produce sufficient contact between the surfaces 52, 72 when the two parts 50, 70 are subsequently bonded together. In some examples, one or more of hot section part 50 and cold section part 70 may be initially machined to a nominal size (e.g., machined to a set standard of specifications) allowing the respective parts to be incorporated interchangeably with corresponding parts rather than the being machined to part specific specifications (e.g., serial number pairing of a hot section part to a cold section part).

In some examples, the chemical etching process may be performed by applying a masking material 56 to the respective bonding surface 52 of the part to be etched (e.g., hot section part 50). In some examples, masking material 56 may define a cooling channel pattern (e.g., pattern of channels 74) on surface 52 of the hot section part 50. Masking material 56 is suitably selected to prevent chemical etching of the corresponding surfaces of hot section part 50 that are covered by masking material 56 and allow for removal of masking material 56 once the etching process is complete. Suitable materials for masking material 56 may include, for example, photoresist materials.

Any suitable etchant may be used to chemically etch hot section part 50, which may include, for example, an aqueous solution including nitric acid, acetic acid, hydrochloric acid and/or other acids or dopants to modify the control and rate for the etching process.

Once etched, masking material 56 may be removed and the hot section part 50 and cold section part 70 may be bonded together (112) along the respective corresponding and complementary bonding surfaces 52 and 72 to form a dual-walled component 80. In some examples, hot section part 50 and cold section part 70 may be bonded such that the respective bond joints 76 are formed at the interface and union between plurality of support structures 58 and cold section part 70 so that bond joint 76 is set further away from the heated gas environment (e.g., environment in contact with exterior surface 54 of hot section part 50) compared to traditional dual-walled components.

Any suitable bonding technique may be used to bond cold section part 70 to hot section part 50 including, for example, diffusion bonding, brazing, adhesive bonding, welding, or the like. For example, a bonding material may be applied, e.g., rolled, on bonding surfaces 52 or the respective support structures 58. Cold section part 70 and hot section part 50 may then be brought into direct contact along bond surfaces 55 and 72 and heated to an elevated temperature to induce boding of the bonding material between cold section part 70 and hot section part 50 to form bond joints 76. Example techniques and apparatuses used for performing bonding of dual-walled components are described in U.S. patent application Ser. No. 15,184/235 filed Jun. 16, 2016 entitled AUTOMATED COATING APPLICATION, and U.S. patent application Ser. No. 14/727,593 filed Jun. 1, 2015 entitled FIXTURE FOR HIGH TEMPERATURE JOINING, both of which are incorporated by reference in their entirety.

In some examples, bonding hot section part 50 and cold section part 70 together to form dual-walled component 80 may be performed without subjecting etched part 60 to an adaptive machining process designed to pair the bonding surfaces of plurality of support structures 58 (e.g., surface 52 post etching) to bonding surface 72 or cold section part 70. As described above, the chemical etching process may provide a convenient means of defining support structures 58 in one or more cold section part 70 or hot section part 50 after the parts have been machined to a nominal size with corresponding and complementary surfaces (surfaces 52 and 72). Because cold section part 70 and hot section part 50 may be suitably machined to pair with one another prior to the formation of support structures 58, adaptive machining technique may, in some examples, be altogether excluded from the production process of dual-walled component 80.

In some examples, prior to bonding of cold section part 70 to hot section part 50, plurality impingement apertures 68 and cooling apertures 64 (collectively apertures 64, 68) may be formed in respective cold section part 70 and hot section part 50. The apertures 64, 68 may be formed using any suitable technique including, for example, mechanical drilling, laser ablation (e.g., picosecond or femtosecond pulsed lasers), electro-chemical machining, or the like. In some examples, apertures 64, 68 may be introduced within respective hot or cold section parts 50, 70 at an angle to a surface 54, 72 of the part (e.g., an offset angle compared to the normal or respective surfaces 54, 72). In some examples, apertures 54, 72 may define an angle of incidence of about 10 degrees to about 75 degrees (i.e., with 90 degrees representing the perpendicular/normal to a respective surface). In some examples, one or more of cooling apertures 64 may include a fanned Coanda ramp path at the point of exit from surface 54 of hot section part 50 to assist in the distribution or film characteristics of the cooling air as it exits the respective cooling apertures 64. In some examples, the diameter of apertures 64, 68 may be less than about 0.01 inches to about 0.12 inches in diameter (e.g., about 0.25 millimeters (mm) to about 3 mm).

In some examples one or more exterior layers or coatings (not shown) may be applied to exterior surface of 54 of hot section part 50. Example layers or coatings may include, for example, bond coats, thermal barrier coatings, environmental barrier coatings, CMAS-resistant coatings, or the like. Such layers or coatings may be applied to hot section part 50 at any suitable point in the process of forming dual-walled component 80.

FIG. 6 is a flow diagram illustrating another example technique of forming a dual-walled component for a gas turbine engine. The technique of FIG. 6 includes forming a hot section part 50 and a cold section part 70 each having corresponding complementary surfaces 52 and 72 (120). As described above, the respective hot section part 50 and cold section part 70 may correspond to a coversheet and spar, respectively, for an airfoil of a gas turbine engine. In some examples, the respective hot section part 50 and cold section part 70 may be formed by casting the respective parts without forming support structures 58 during the casting process. The respective hot section part 50 and a cold section part 70 may then be machined to a nominal size (e.g., machined to a set standard of specifications) allowing the respective parts to be used interchangeably with a corresponding part rather than the being machined to part-specific specifications (e.g., serial number pairing of a hot section part to a cold section part).

Once corresponding and complementary surfaces 52 and 72 of respective hot section part 50 and a cold section part 70 have been sufficiently shaped, a masking material 56 may be applied to at least one of the corresponding complementary surfaces 52 or 72 of the respective hot section part 50 or the cold section part 70 (122). As described above, masking material 56 may define a cooling channel pattern (e.g., pattern of cooling channels 104 of FIG. 5) along the surface of the part to be etched. The masked part may then be immersed in a chemical etchant to etch the corresponding complementary surfaces (e.g., surface 52) of the hot section part or the cold section part to form a plurality of support structures 58 within the surface (124). Any suitable etchant may be used, such as an aqueous solution including nitric acid, acetic acid, hydrochloric acid, other acids, and the like to define cooling channels 74 and support structures 58 within the etched part 60.

The technique of FIG. 6 also includes forming a plurality of impingement apertures 68 in cold section part 70 (126) and a plurality of cooling apertures 64 in hot section part 50 (128). Apertures 64, 68 may be formed at any suitable point during the formation of dual-walled component 80. For example, apertures 64, 68 may be formed during the casting process of forming respective hot section part 50 and cold section part 70; prior to machining corresponding and complementary surfaces 52, 72; prior to chemically etching at least one of hot section part 50 or cold section part 70 (124); after chemically etching at least one of hot section part 50 or cold section part 70 (124); or as part of chemically etching at least one of hot section part 50 or cold section part 70 (124). As described above, apertures 64, 68 may be formed using any suitable technique including, for example, casting, mechanical drilling, laser ablation (e.g., picosecond or femtosecond pulsed lasers), electro-chemical machining, etching, or the like.

The technique of FIG. 6 also includes bonding hot section part 50 to cold section part 70 along the corresponding complementing surfaces 52, 72 to form the dual-walled component 80 with plurality of support structures 58 defining at least one cooling channel 74 within dual-walled component 80 (130). Any suitable bonding technique may be employed including, for example, diffusion bonding, brazing, adhesive bonding, welding, or the like. Once dual-walled component 80 has been formed, the component may be installed in a gas turbine engine (132).

Various examples have been described. These and other examples are within the scope of the following claims.

What is claimed is:

1. A dual-walled component for a gas turbine engine comprising:

a cold section part defining an interior surface facing a cooling gas plenum and a bonding surface;

a hot section part defining an exterior surface facing a heated gas environment, wherein the hot section part comprises a plurality of support structures defining at least one cooling channel between the hot section part and the cold section part, wherein at least some of the support structures of the plurality of support structures are bonded to the cold section part to define bond joints between the hot section part and the cold section part, and wherein the bond joints inhibit transfer of heat from the plurality of support structures to the cold section part.

2. The dual-walled component of claim 1, wherein a thermal conductivity of the bond joint is less than a thermal conductivity of the hot section part.

3. The dual-walled component of claim 1, wherein a width of each support structure of the plurality of support structures is between about 0.2 millimeters and about 2 millimeters.

4. The dual-walled component of claim 1, wherein a height of each support structure of the plurality of support structures is between about 0.2 millimeters and about 2 millimeters.

5. The dual-walled component of claim 1, wherein a width of each cooling channel of the at least one cooling channel is between about 0.2 millimeters and about 2 millimeters.

6. The dual-walled component of claim 1, wherein the hot section part comprises an interior surface facing the at least one cooling channel, wherein the hot section part comprises a plurality of cooling apertures extending from the exterior surface to the interior surface, and wherein respective cooling apertures of the plurality of cooling apertures are fluidically connected to respective cooling channels of the plurality of cooling channels.

7. The dual-walled component of claim 6, wherein at least a portion of the plurality of cooling apertures is oriented at an incidence angle less than 90 degrees to the exterior surface of the hot section part.

8. The dual-walled component of claim 6, wherein the at least a portion of the plurality of cooling apertures is oriented at an incidence angle between about 10 degrees and about 75 degrees to the exterior surface of the hot section part.

9. The dual-walled component of claim 6, wherein at least a portion of the plurality of cooling apertures include a fanned Coanda ramp path at a point of exit at the exterior surface.

10. The dual-walled component of claim 6, wherein each cooling aperture of the plurality of cooling apertures has a diameter between about 0.25 millimeters and about 3 millimeters.

11. The dual-walled component of claim 1, wherein the cold section part comprises a plurality of impingement apertures, wherein respective impingement apertures of the plurality of impingement apertures are fluidically connected to respective cooling channels of the plurality of cooling channels.

12. The dual-walled component of claim 11, wherein at least a portion of the plurality of impingement apertures is oriented at an incidence angle less than 90 degrees to the interior surface of the cold section part.

13. The dual-walled component of claim 11, wherein the at least a portion of the plurality of impingement apertures is oriented at an incidence angle between about 10 degrees and about 75 degrees to the interior surface of the cold section part.

14. The dual-walled component of claim 11, wherein each impingement aperture of the plurality of impingement apertures has a diameter between about 0.25 millimeters and about 3 millimeters.

15. The dual-walled component of claim 1, wherein the dual-walled component comprises an airfoil.

16. The dual-walled component of claim 15, wherein the hot section part is a coversheet and the cold section part is a spar.

17. The dual-walled component of claim 16, wherein the coversheet comprises an interior surface facing the at least one cooling channel, wherein the coversheet comprises a plurality of cooling apertures, wherein respective cooling apertures of the plurality of cooling apertures are fluidically connected to respective cooling channels of the plurality of cooling channels, and wherein the plurality of cooling apertures are positioned along a leading edge of the airfoil.

18. The dual-walled component of claim 1, wherein the bonding surface of the hot section part is a concave surface.

19. The dual-walled component of claim 1, further comprising an exterior layer on the exterior surface of the hot section part.

20. The dual-walled component of claim 19, wherein the exterior layer comprises at least one of a thermal barrier coating (TBC), an environmental barrier coating (EBC), or a calcia-magnesia-alumina-silicate (CMAS) resistant coating.

* * * * *